US006116682A

United States Patent [19]

Baur

[11] Patent Number: 6,116,682

[45] Date of Patent: Sep. 12, 2000

[54] SEATING DEVICE

[76] Inventor: Albert Baur, Finkenweg 12, 86845 Grossaitingen, Germany

[21] Appl. No.: 09/180,428

[22] Filed: Nov. 5, 1998

[30] Foreign Application Priority Data

May 6, 1996 [DE] Germany ..... 196 17 966

[51] Int. Cl.[7] ..... A47C 31/00; A63G 9/10

[52] U.S. Cl. ..... 297/181; 297/118; 297/378.1; 297/344.21; 297/344.26; 297/283.2

[58] Field of Search ..... 297/181, 1, 283.2, 297/118, 344.18, 344.26, 344.21, 344.22, 256.15, 378.1, 378.14; 472/137; D6/358, 345

[56] References Cited

U.S. PATENT DOCUMENTS 4,790,593 12/1988 Davalos et al. ..... 297/256.15

*Primary Examiner*—Anthony D. Barfield
*Attorney, Agent, or Firm*—Hickman Coleman & Hughes, LLP

[57] ABSTRACT

A seating device including a frame, a seat fitted above the frame and surrounded by a seat shell and coverable by an upper half-shell. The upper half-shell is hinged to the seat shell and in covering relationship to the seat. The seat shell and the half-shell together form a ball and the half-shell further takes the form of a back rest.

12 Claims, 5 Drawing Sheets

Figure 1:
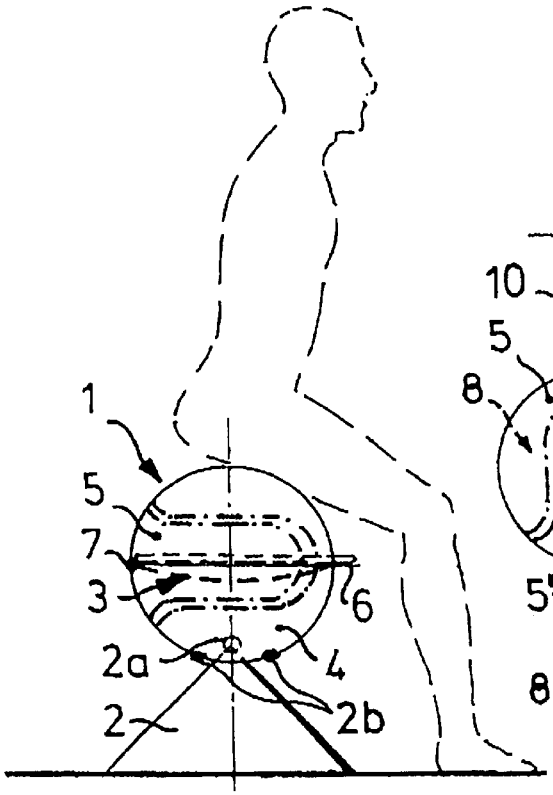

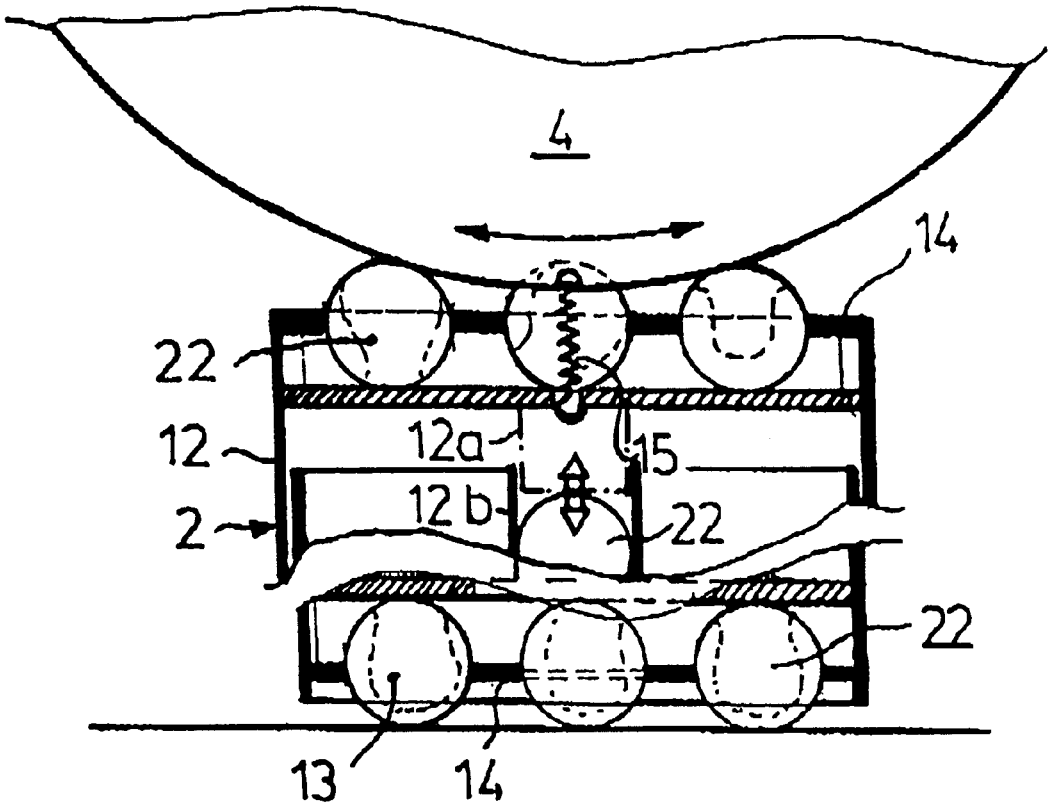
FIG.6
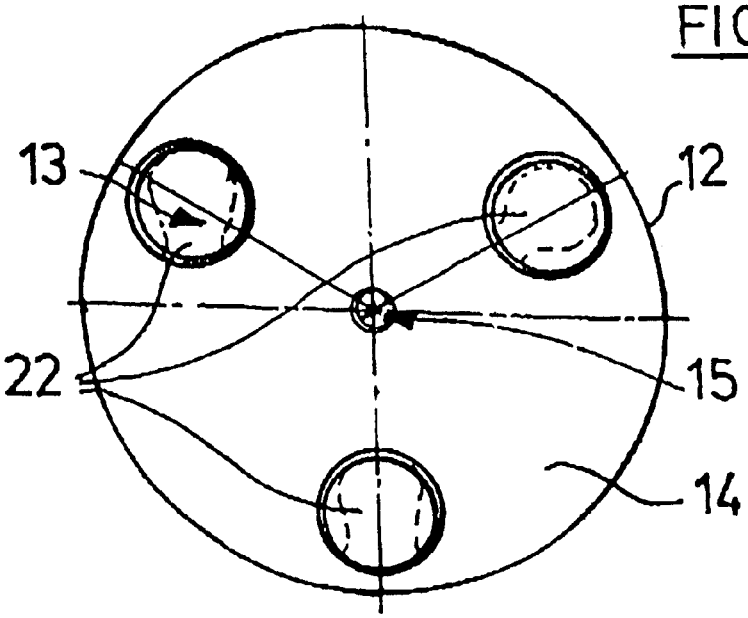

SEATING DEVICE

This application claims priority benefit of International Application No. PCT/EP97/02272, filed May 5, 1997, the disclosure of which is incorporated herein by reference, which claimed priority benefit of German Application No. 196 17 966.1, filed May 6, 1996, the disclosure of which is incorporated herein by reference.

The invention relates to a chair or stool with a seat fitted above a frame.

This type of chair or stool with a seat is widely used in the leisure field, for example as seating on terraces, for open-air events and as garden furniture. Such chairs or stools normally have a wooden or plastic seat because these materials are adequately weather-proof. But for use on terraces or as garden furniture the seat is fitted with extra cushions to provide additional comfort. However, this gives rise to the problem that in the event of a sudden storm or shower these cushions get wet, necessitating their frequent removal. But this is extremely time-consuming, as it may be necessary on a restaurant terrace, for example, to remove and replace such cushions several times a day. A further problem is dust, which can cause soiling to seats, backs and arm-rests as a result of which such upholstered seating can sometimes be used by guests only with great care. This is particularly true of tennis areas, which are often quite dusty, especially with sand courts, and where white clothing is generally worn. Seating in the vicinity of tennis courts thus inevitably gets dirty.

The invention is consequently based on the objective of creating a weatherproof chair or stool, the seat of which can be kept clean.

This objective is achieved in the chair or stool with the characteristics described in patent claim 1.

By placing an upper half-shell above the lower seat shell, preferably with one or more upholstered seats, this seat is covered when not in use and thus protected from rain and dust. The upper half-shell is either attached to the seat shell by a hinge or is inserted into it, making it very easy to open and close, thus eliminating the time-consuming removal and replacement of cushions. The fact that the seat shell and the half-shell form a ball is also advantageous, both in that this provides a maximum of stowage space for the seat and/or back and arm-rests and in that the amount of material used to manufacture the seat shell is minimised in relation to the stowage volume.

Moreover, these two hemispherical plastic shells in PE or PP (polyethylene or polypropylene), for example, are highly stable. Furthermore, since the seat shell and half-shell form a sphere when fitted together, they can be made to resemble the ball used in this or that sport. The seating at a tennis club, for example, could be designed to look like tennis balls, while at a soccer pitch the normal black-and-white surface of a football could be used.

Other applications include handballs, basketballs, table-tennis balls and the like, as these all have a distinctive surface. The same is true of other games such as billiards, for which the seating could be designed with the colouring and numbers characteristic of billiards (snooker or pool billiards). When designed as bowling balls for ten-pin bowling or skittles the seating would incorporate finger-holes with which the upper half-shell would be opened. Although these last-named sports are generally played indoors the reduction of dust contamination is secondary, while the additional objective as stowage space and as a design element for the sport in question comes to the fore. This is particularly true of special skittles or billiards halls, where the seating would preferably take the form of bar stools.

Moreover, the upper half-shell preferably forms a back-rest, producing a very comfortable chair, particularly in the version with two opposed folding rest components, which thus also incorporates a head-rest. Furthermore, a foot-rest can be folded out of or retracted from the seat or the lower seat shell, or inserted into it, thus further increasing comfort in use.

A particular advantage is the possibility of forming stowage spaces inside the lower seat shell and/or the upper half-shell, giving a guest or visitor at an open-air event somewhere to store items brought with him such as articles of clothing, handbags, sports bags, sports equipment and the like. This applies particularly with the additional possibility of a lockable stowage compartment in which items can be safely locked away while, for example, their owner is playing a game of tennis. This enables necessary sports equipment to be protected from theft in the chair.

Figure 2:
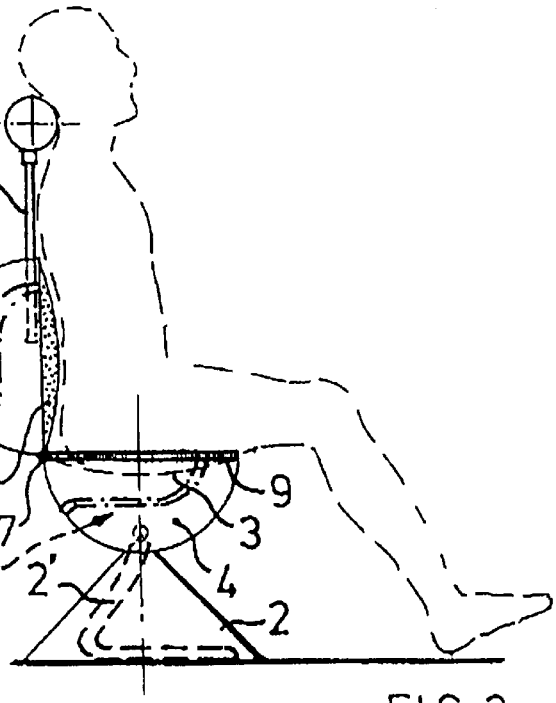
Figure 3:
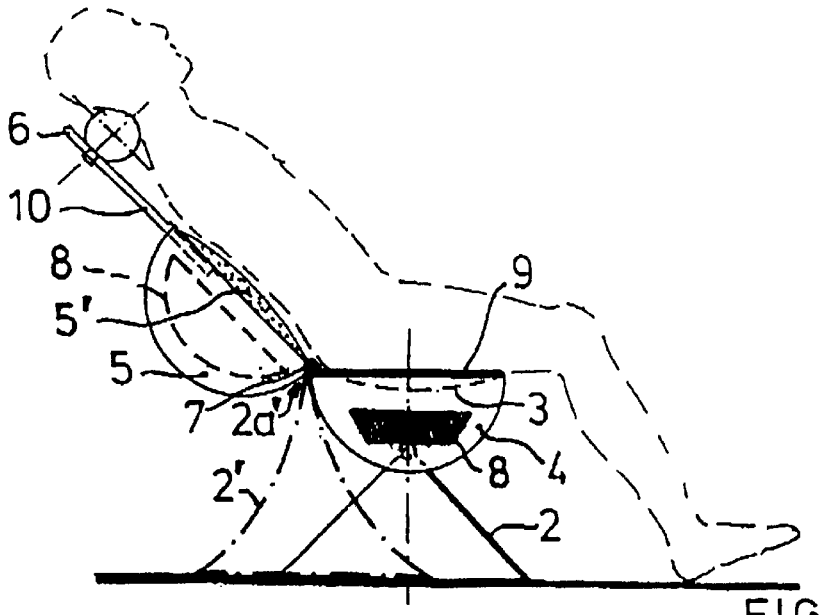
Figure 4:
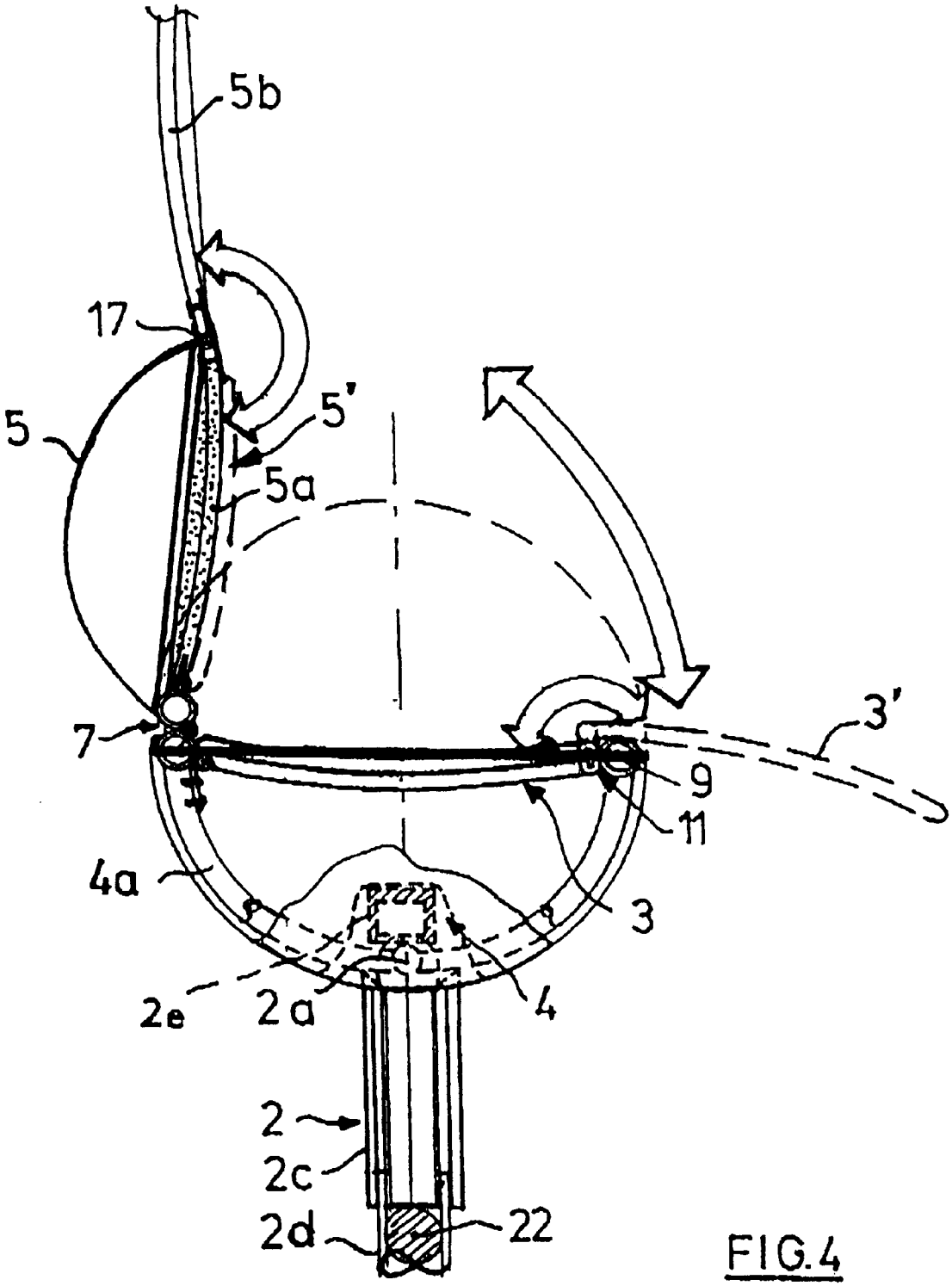
Figure 5:
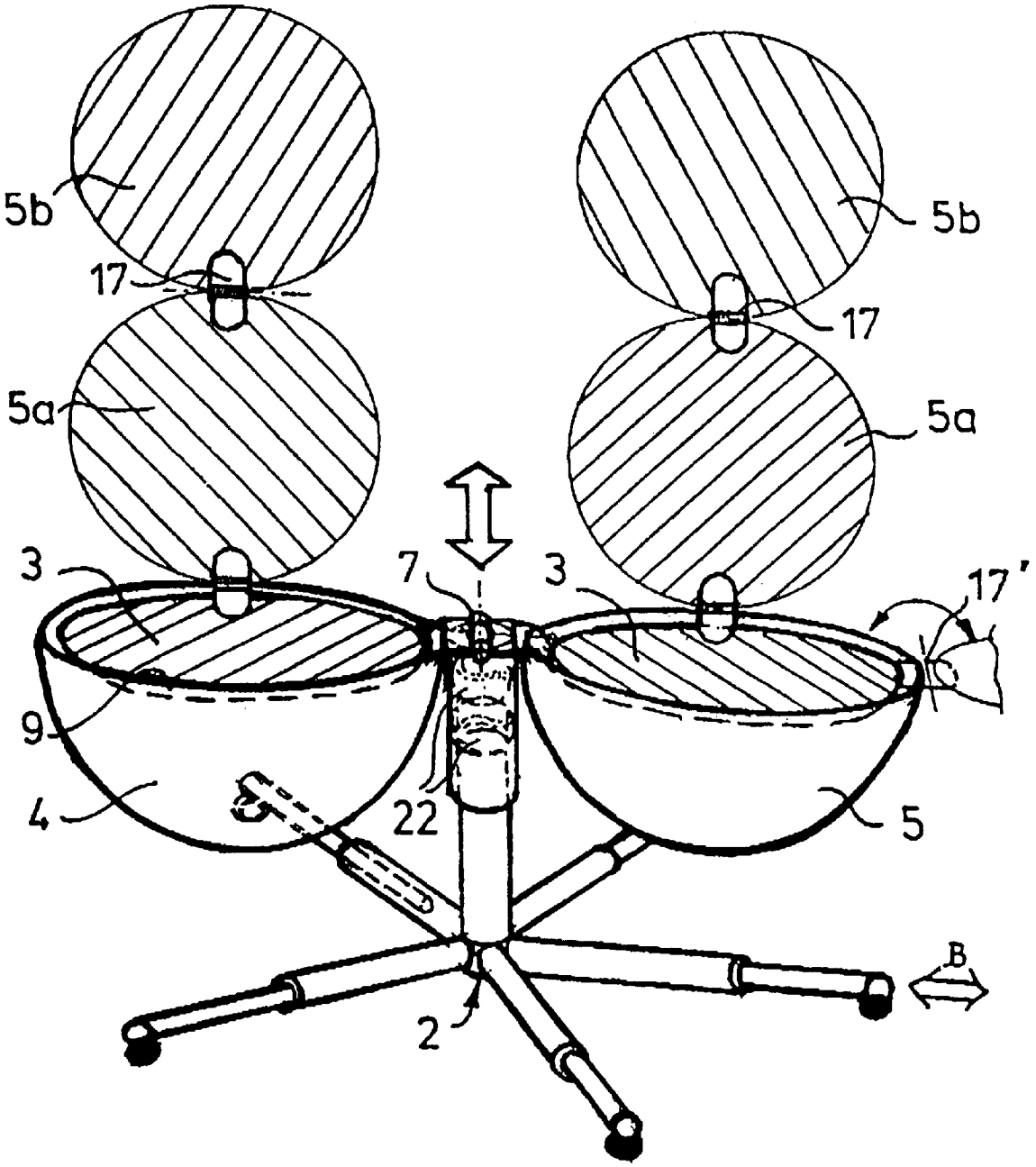

Further advantageous versions are the subject of the subclaims. Several embodiments of the seating will now be described and explained in more detail. The drawings show:

FIG. 1 a side view of a chair in the form of a tennis ball in the closed position;

FIG. 2 the chair of FIG. 1 in the opened position;

FIG. 3 a side view of the chair in FIG. 1 and FIG. 2 opened further for a more comfortable seated posture;

FIG. 4 a modified version with opposed folding rest components as an alternative to the telescopic design shown in FIG. 2 and FIG. 3;

FIG. 5 a front view of a double version with telescopic frame;

FIG. 6 a detailed depiction of the frame in side and plan views; and

Figure 7:
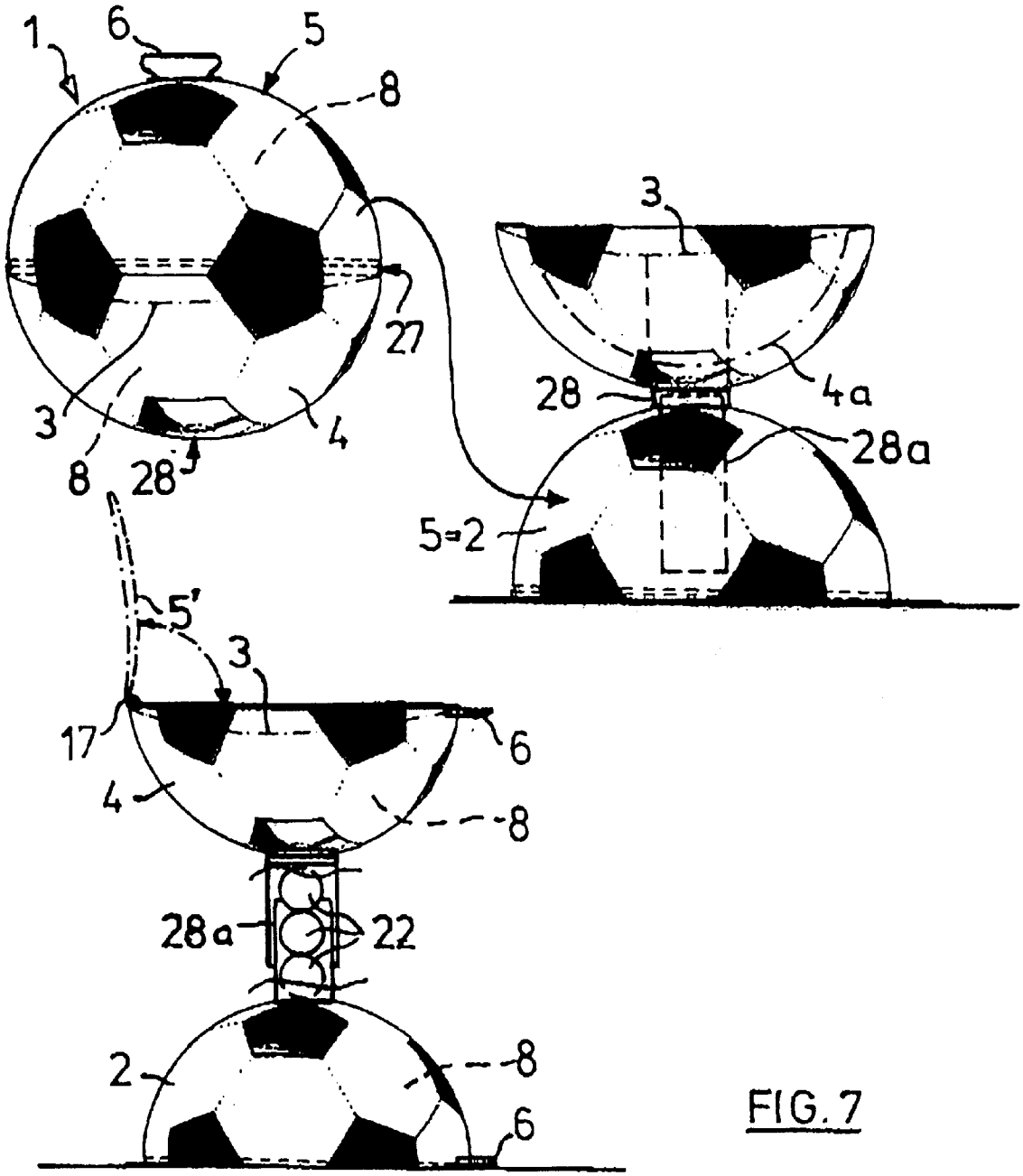

FIG. 7 an especially simple, insertable version of the chair shown in the open, closed and raised positions.

In FIG. 1 a chair 1 is shown in the closed position, wherein a seat shell 4 and upper half-shell 5 are fitted above a frame 2, which here is spherical. The seat shell 4 and half-shell 5 together form a ball. A seat 3 incorporated in the lower seat shell 4 can be used when the upper half-shell 5 has been opened, as shown in FIG. 2. It must be noted, however, that as shown in FIG. 1 a person, a tennis line judge for example, can also sit on the upper half-shell 5 for short periods. The seat shell 4 is here linked to the frame 2 by a hinge joint 2*a* and limit stops 2*b*, permitting limited lateral movement in all spatial axes. Moreover, a telescopic height-adjustment device (possibly motorised) should preferably be incorporated in the frame 2 so that this chair 1 can also assist the user to stand. As mentioned above the surface is specially designed here, for example, as a tennis ball.

After the upper half-shell 5 has been opened to an angle of about 90°, preferably by means of a front handle 6, the position shown in FIG. 2 is reached, the opened half-shell 5 thus forming a back-rest 5'. The separation plane between the seat shell 4 and the upper half-shell 5 is here roughly central and horizontal, but it could also be slightly displaced or curved. The join between the lower seat shell 4 and the upper half-shell 5 is fitted with a ring seal 9, which forms a rainproof seal between the two shells 4 and 5 in the closed position and also protects the edges in the sitting position, particularly when the ring seal 9 is made of rubber or soft plastic. The separation plane between the seat shell 4 and the upper half-shell 5 is also fitted with a hinge 7, which may also take the form of a double joint with various engagement positions, e.g. 90°, 105°, 120° (cf. FIG. 3) or 180° (cf. FIG. 5). For example, this allows the vertical position (FIG. 2) or the semi-supine position (FIG. 3) to be set. When the half-shell 5 is open it forms the back-rest 5', shown as a dotted line, an advantage of this being that the concave shape of the seat 3 marries with the domed or convex shape of the back-rest 5', resulting in a highly compact design. To increase comfort a telescopic extension 10—which can at the same time function as a handle 6—is fitted in the half-shell 5. This forms a comfortable head-rest.

The essential feature here is that a stowage space 8 is formed in the seat shell 4 beneath the seat 3 and/or in the half-shell 5, enabling objects (shown in black in FIG. 3) to be securely stored. To this purpose the seat 3 could also be attached to the hinge 7, enabling it to be opened so that articles of clothing, handbags and the like can be placed in the lower seat shell 4. The same applies to the stowage space 8 in the back-rest 5'. An alternative version of the frame 2 is also shown in broken lines in FIG. 2 as a so-called "swinger" with a sprung steel-tube support 2'.

FIG. 3 shows a more comfortable sitting position of the chair 1 in which the back-rest 5' has been lowered from the rather upright sitting position in FIG. 2 into a semi-supine position. The hinge 7 has appropriate locking positions or a spring support. The twist position of the seat shell 4 with respect to the frame 2 can also be adjustable in the manner of office chairs. The broken lines also show a further version 2' of the frame 2, funnel or trumpet-shaped, the hinge joint being fitted in the vicinity of the hinge 7 in order to achieve a superior distribution of the centre of gravity. Here the half-shell 5 can also be lowered even further to produce a double chair as shown in FIG. 5.

FIG. 4 shows an extended version of the chair 1 in which the back-rest 5' consists of two opposed folding rest components 5*a* and 5*b*. When not in use these rest components 5*a* and 5*b* fold over each other, their matching vaulted shape ensuring a minimal space requirement. The same is true of the foot-rest 3' which folds out of the seat 3 and which is linked to the front of the seat 3 with a hinge joint 11. This joint 11 is attached to the hemispherical or stripe-shaped tube support 4*a,* which fits inside the seat shell 4 and is connected to the tilting joint. The foot-rest 3' can also be retractable in the manner of telescop.

In this version an adapted version of the frame 2 is shown in which there is at least one tennis ball 22 inside the telescopic tube of the frame 2 for a spring effect and/or height adjustment. The telescopic tube of the frame 2 here consists of two telescopic sections 2*c* and 2*d,* one of which fits into the other, preferably the lower section 2*d* fitting into the upper section 2*c* in order to prevent water draining from above from penetrating the telescopic tube. The insertion of one, two, three or four tennis balls 22 makes the height of the seat 3 and the spring effect simple to adjust. This is an especially sensible way of recycling used tennis balls. A further modification of the frame 2 involves a horizontal rod 2*e* which goes into a recess in the seat shell 4. This horizontal rod 2*e* can extend through several seat shells 4, thus forming a kind of row of seats. This version is particularly suitable for stadia or sports fields, the horizontal rod 2*e* permitting a limited tilting movement (in the drawing plane).

FIG. 5 also shows the frame 2 cushioned by two tennis balls 22, this being a double version with two seats 3 shown in front view. This shows the folded-out version of the back-rest 5' clearly, the shaded areas 3, 5*a* and 5*b* being suitable to carry advertising messages, for example for a football club. Here the arrow B highlights a radial telescopic extension of the frame 2 which, for example, would reduce the space required for the transportation of the frame 2. This applies particularly if the frame 2 can be dismantled and placed in one or both of the stowage spaces 8 in the seat shells 4 or half-shells 5. This also reduces the space required. It should be noted that here the hinges 17 for the rest components 5*a* and 5*b* are mounted to one side of the main hinge 7 (which here incorporates the hinge joint 2*a*), so that the whole item can be folded into one ball. Other swivelling parts could also be connected or inserted—storage trays, for example—by means of a hinge 17'.

FIG. 6 also shows a modified version of the frame 2 in which the seat shell 4 is supported in such a way that it can be swivelled in several axes with respect to the frame 2. This is formed from a pedestal 12 with at least three roller and spring elements 13 both above and below it, which once more are preferably tennis balls or other rubber spheres. These are fitted in the pedestal 12 between upper and lower guide plates 14 so that when the chair 1 is under load the frame 2 is automatically arrested and immobilised. This possibility of utilising used tennis balls is of particular significance, since besides representing a continuation of the ball motif it constitutes a sensible re-use of these balls 22 as rollers. With its three-point support this frame 2 could also be used for other items of furniture.

The seat shell 4 is here fixed with respect to the frame 2 by means of a tension spring 15, but this does not prevent the seat shell 4 from swivelling within an angle of some 50° in the spatial dimensions. The pedestal 12 can also be executed in two parts, taking telescopic form as 12*a* and 12*b* with tennis-ball springing 22. The half-shell 5 and seat shell 4 are preferably identical, viz. both taking the form of hemispherical shells in deep-drawn thermoplast or duroplast, on which the characteristic surface, e.g. of a basketball can be embossed or printed.

Finally FIG. 7 shows a particularly simple version of the chair 1 in the form of a soccer/football in the closed, opened and raised positions. In contrast to the forms previously described the hinged linkage between the upper half-shell 5 and the lower seat shell 4 is replaced by an insertable connection 27 which substantially runs through the centre plane of the ball-chair 1. This insertable connection 27 may have sprung lugs or tongues or a bayonet fastening, so that the upper half-shell 5 can be clipped or screwed onto the seat shell 4. Once the plug connection 27 has been undone the upper half-shell 5 can be plugged in beneath the seat shell 4, preferably by an intermediate joint 28 which is kept in the stowage space 8 when the chair is closed. This can be fitted through little caps at the vertices of the two shells 4 and 5, and is firmly connected to the internal frame 4*a,* for example with a quick-release fastening or a winged nut. Thus, the component which in the closed position forms the upper half-shell 5 simultaneously forms the frame 2 of the chair 1. The intermediate joint 28 can also take the form of a swivelling ball-and-socket joint permitting a limited swivelling movement to the left, right, front and back. The intermediate joint 28 can also take telescopic form 28*a,* the tennis-ball springing 22 preferably once again being used. This permits the height of the chair to be adjusted to suit the user.

The seat shell 4 and/or half-shell 5 are also fitted with at least one handle 6 enabling the upper seat shell 5 to be removed easily. Preferably, however, both the shells should be fitted with handles, enabling them to be simply transported like a suitcase for camping purposes and the like. Objects could be placed in the two stowage spaces 8 of the two shells 4 and 5. The components necessary to connect the two shells 4 and 5, such as the intermediate joint, can also be placed in the two stowage spaces 8. It should be noted, however, that the intermediate joint 28 can also be fitted permanently to the two shells or their frame 4*a* so that they could be plugged together after opening little caps at their vertices. The plug connection 27 simultaneously functions as a support surface when the upper halfshell 5 is being used as the frame 2. Finally it should be noted that the term "half-shell" can also be understood to mean flattened hemispheres or ellipses or flat cylinders, for example as with the ball used in "American football" or "Rugby". When the seat shell 4 and half-shell 5 take the form of a flattened cylinder the frame 2 can be folded into one of these components.

What is claimed:

1. A seating device comprising:

a frame;

a seat fitted above said frame and surrounded by a seat shell; and an upper half-shell which is hinged to the seat shell and in covering relationship to the seat, where the seat shell and the half-shell together form a ball and wherein the half-shell takes the form of a back rest.

2. A seating device in accordance with claim 1 wherein the back-rest includes two opposed folding rest components.

3. A seating device in accordance with claim 1 further comprising a foot-rest connected to a front of the seat by a hinge, whereby the foot-rest is foldable out of the seat.

4. A seating device in accordance with claim 1 wherein the frame incorporates at least one roller and spring element providing at least one of a spring effect and a height adjustment.

5. A seating device in accordance with claim 4 wherein the frame is provided with a telescopic tube including two telescopic components which fit into each other.

6. A seating device in accordance with claim 1 wherein the frame includes a suspension support.

7. A seating device in accordance with claim 1 further comprising a stowage space provided by the seat shell.

8. A seating device in accordance with claim 1 further comprising a ring seal, wherein said ring seal is disposed between the seat shell and the upper half-shell.

9. A seating device in accordance with claim 1 wherein the seat shell is connected to the frame with a hinge joint, whereby the seat shell can swivel.

10. A seating device in accordance with claim 1 wherein the frame has a pedestal incorporating at least three roller and spring elements.

11. A seating device in accordance with claim 1 wherein the frame includes a horizontal rod.

12. A sitting device in accordance with claim 1 wherein the surfaces of the seat shell and the half-shell exhibit characteristics of a particular sport.

* * * * *